US008980079B2

(12) United States Patent
Yost, III et al.

(10) Patent No.: US 8,980,079 B2
(45) Date of Patent: Mar. 17, 2015

(54) ELECTROLYTIC CELL FOR OZONE PRODUCTION

(75) Inventors: William J. Yost, III, Newton, MA (US); Carl David Lutz, Windham, NH (US); Jeffrey D. Booth, Andover, MA (US); Donald J. Boudreau, Tewksbury, MA (US); Nicholas R. Lauder, Somerville, MA (US)

(73) Assignee: Electrolytic Ozone, Inc., Wilmington, MA (US)

( * ) Notice: Subject to any disclaimer, the term of this patent is extended or adjusted under 35 U.S.C. 154(b) by 443 days.

(21) Appl. No.: 13/310,406

(22) Filed: Dec. 2, 2011

(65) Prior Publication Data

US 2012/0138478 A1 Jun. 7, 2012

Related U.S. Application Data

(60) Provisional application No. 61/419,574, filed on Dec. 3, 2010.

(51) Int. Cl.

| | |
|---|---|
| ***C25B 1/13*** | (2006.01) |
| *C25B 11/12* | (2006.01) |
| *C25B 9/08* | (2006.01) |

(52) U.S. Cl.

CPC ... *C25B 1/13* (2013.01); *C25B 9/08* (2013.01); *C25B 11/12* (2013.01)

USPC ..... 205/626; 204/294; 204/252; 204/229.4

(58) Field of Classification Search

CPC ..... C25B 1/13

USPC ..... 205/626

See application file for complete search history.

(56) References Cited

U.S. PATENT DOCUMENTS

| | | | | |
|---|---|---|---|---|
| 5,299,247 | A | 3/1994 | Widdershoven et al. | 377/60 |
| 5,776,323 | A | 7/1998 | Kobashi | 204/294 |
| 5,900,127 | A | 5/1999 | Iida et al. | 204/290 F |
| 6,254,762 | B1 | 7/2001 | Uno et al. | 205/466 |
| 6,306,270 | B1 | 10/2001 | Hänni et al. | 204/268 |
| 6,315,886 | B1 | 11/2001 | Zappi et al. | 205/701 |

(Continued)

FOREIGN PATENT DOCUMENTS

| | | | |
|---|---|---|---|
| EP | 0 822 271 A2 | 2/1998 | C25B 1/28 |
| EP | 0 822 271 A3 | 9/1998 | C25B 1/28 |

(Continued)

OTHER PUBLICATIONS

Authorized Officer Yolaine Cussac, International Preliminary Report on Patentability; PCT/US2011/063128, mailed Jun. 13, 2013, 2010, 10 pages.

(Continued)

*Primary Examiner* — Keith Hendricks
*Assistant Examiner* — Salil Jain
(74) *Attorney, Agent, or Firm* — Sunstein Kann Murphy & Timbers LLP

(57) ABSTRACT

An electrolytic cell includes at least one free-standing diamond electrode and a second electrode, which may also be a free-standing diamond, separated by a membrane. The electrolytic cell is capable of conducting sustained current flows at current densities of at least about 1 ampere per square centimeter. A method of operating an electrolytic cell having two diamond electrodes includes alternately reversing the polarity of the voltage across the electrodes.

14 Claims, 7 Drawing Sheets

(56) References Cited

U.S. PATENT DOCUMENTS

| | | | | |
|---|---|---|---|---|
| 6,375,827 | B1 | 4/2002 | Kurosu et al. | 205/687 |
| 6,391,183 | B1 | 5/2002 | Tanioka et al. | 205/626 |
| 6,423,193 | B1 | 7/2002 | Miller et al. | 204/242 |
| 6,487,986 | B1 | 12/2002 | Liehr et al. | 118/723 MW |
| 6,533,916 | B1 | 3/2003 | Puetter et al. | 205/188 |
| 6,855,242 | B1 | 2/2005 | Comninellis et al. | 205/471 |
| 7,074,316 | B2 | 7/2006 | Haibara et al. | 205/521 |
| 7,094,329 | B2 | 8/2006 | Saha et al. | 205/465 |
| 7,217,347 | B2 | 5/2007 | Hosonuma et al. | 204/294 |
| 7,273,536 | B2 | 9/2007 | Shibata et al. | 204/294 |
| 7,285,194 | B2 | 10/2007 | Uno et al. | 204/294 |
| 7,309,441 | B2 | 12/2007 | Rychen et al. | 210/748 |
| 7,335,284 | B2 | 2/2008 | Haenni et al. | 204/257 |
| 7,335,285 | B2 | 2/2008 | Furuta et al. | 204/294 |
| 7,438,790 | B2 | 10/2008 | Hosonuma et al. | 204/294 |
| 7,468,121 | B2 | 12/2008 | Hosonuma et al. | 204/290.12 |
| 7,704,353 | B2 | 4/2010 | Stadelmann et al. | 204/263 |
| 7,858,551 | B2 | 12/2010 | Takasu et al. | 502/101 |
| 7,887,679 | B2 | 2/2011 | Kitaori et al. | 204/260 |
| 7,951,274 | B2 | 5/2011 | Yoshida et al. | 204/294 |
| 7,964,068 | B2 | 6/2011 | Kitaori et al. | 204/260 |
| 8,361,289 | B2 * | 1/2013 | Whitehead et al. | 204/294 |
| 8,440,080 | B2 * | 5/2013 | Salama et al. | 210/243 |
| 2002/0106550 | A1 | 8/2002 | Nishiki et al. | 429/42 |
| 2006/0066203 | A1 | 3/2006 | Uno et al. | 313/311 |
| 2006/0249374 | A1 | 11/2006 | Wunsche et al. | 204/242 |
| 2006/0261349 | A1 | 11/2006 | Doering et al. | 257/77 |
| 2007/0023273 | A1 | 2/2007 | Kitaori et al. | 204/164 |
| 2007/0029190 | A1 | 2/2007 | Hosonuma et al. | 204/280 |
| 2007/0272550 | A1 | 11/2007 | Shiue et al. | 204/267 |
| 2008/0053840 | A1 * | 3/2008 | Arihara et al. | 205/626 |
| 2008/0060936 | A1 | 3/2008 | Hashimoto et al. | 204/262 |
| 2009/0032409 | A1 | 2/2009 | Horn et al. | 205/688 |
| 2009/0127128 | A1 | 5/2009 | Kitaori et al. | 205/464 |
| 2009/0152123 | A1 * | 6/2009 | Butler et al. | 205/455 |
| 2009/0211918 | A1 | 8/2009 | Hardee | 205/556 |
| 2011/0017606 | A1 | 1/2011 | Uchida et al. | 205/335 |
| 2011/0079520 | A1 | 4/2011 | Tretheway et al. | 205/744 |

FOREIGN PATENT DOCUMENTS

| | | | | |
|---|---|---|---|---|
| EP | 0 949 205 | A1 | 10/1999 | C02F 1/46 |
| EP | 0 822 271 | B1 | 11/2002 | C25B 1/28 |
| EP | 0 949 205 | B1 | 6/2003 | C02F 1/46 |
| EP | 1 754 804 | A1 | 2/2007 | C25B 11/12 |
| JP | H09-13188 | | 1/1997 | C25B 11/12 |
| JP | H0995791 | A | 4/1997 | C25B 1/10 |
| JP | 2000-037693 | | 2/2000 | C02F 1/50 |
| JP | 2005-336607 | | 12/2005 | C25B 11/12 |
| JP | 2006-346203 | | 12/2006 | A61L 2/18 |
| JP | 3901457 | | 4/2007 | H01M 8/02 |
| JP | 2010-521590 | | 6/2010 | C25B 9/04 |
| KR | 10-2010-0014467 | | 2/2010 | C25B 9/06 |
| TW | 2006/17210 | A | 6/2006 | C25B 1/12 |
| TW | 2007/43642 | A | 12/2007 | C02F 1/78 |
| TW | 2008/15627 | A | 4/2008 | C25B 1/13 |
| WO | WO 2008/056337 | A1 | 5/2008 | C25B 1/13 |

OTHER PUBLICATIONS

Attorney Thomas J. Tuytschaevers, Amendment of Claims Under PCT Article 19, Statement Under Article 19(1) and Replacement Pages as filed; PCT/US/2011/063128, Mar. 21, 2013; 12 pages.

Authorized Officer Miriam Lackova, Invitation to Pay Additional Fees and, Where Applicable, Protest Fee; PCT/US2011/063128, Aug. 13, 2012, 7 pages.

Kraft, A. et al., "Electrochemical Ozone Production Using Diamond Anodes and a Solid Polymer Electrolyte," *Electrochemistry Communications,* 8, pp. 883-886, 2006.

Arihara, K., et al., "Electrochemical Production of High-Concentration Ozone-Water Using Freestanding Perforated Diamond Electrodes," *J Electrochem Soc.,* 2007, vol. 154, Issue 4, pp. E71-E75.

Authorized Officer Miriam Lackova, Notification of Transmittal of the International Search Report and the Written Opinion of the International Searching Authority, or the Declaration; PCT/US2011/063128, Jan. 21, 2013, 17 pages.

Walton, C., et al., "Utility of an Empirical Method of Modeling Combined Zero Gap/Attached Electrode Membrane Chlor-Alkali Cells," *Dept. of Chemical Engineering,* Faculty Productions, University of South Carolina Scholar Commons, Jan. 1, 1987, pp. 565C-574C.

Japanese Patent Office, Office Action dated Aug. 5, 2014, pertaining to Application No. 2013-542219, 3 pages.

Japanese Patent Office (English Translation), Office Action dated Aug. 5, 2014, pertaining to Application No. 2013-542219, 5 pages.

Korean Patent Office, Office Action dated Oct. 30, 2014, pertaining to Application No. 10-20137017310, 6 pages.

TIPO, Search Report of TW Patent Application No. 100144631 (w/English Translation) dated Sep. 26, 2013, 8 pages.

* cited by examiner

ELECTROLYTIC CELL FOR OZONE PRODUCTION

RELATED APPLICATIONS

This patent application claims priority from provisional U.S. patent application No. 61/419,574, filed Dec. 3, 2010, entitled, "Electrolytic Cell for Ozone Production," and naming William J. Yost III, Carl David Lutz, Jeff Booth, Don Boudreau, and Nick Lauder as inventors, the disclosure of which is incorporated herein, in its entirety, by reference.

TECHNICAL FIELD

The present inventions relate to electrolytic cells, and more particularly, to ozone producing electrolytic cells having solid electrolyte membranes.

BACKGROUND ART

Electrolytic cells may be used for the production of various chemistries (e.g., compounds and elements). One application of electrolytic cells is the production of ozone. Ozone is an effective killer of pathogens and bacteria and is known to be an effective disinfectant. The U.S. Food and Drug Administration (FDA) approved the use of ozone as a sanitizer for food contact surfaces and for direct application to food products. Accordingly, electrolytic cells have been used to generate ozone and dissolve ozone directly into source water, thereby removing pathogens and bacteria from the water. As a result, electrolytic cells have found applications in purifying bottled water products and industrial water supplies.

SUMMARY OF THE EMBODIMENTS

In a first embodiment there is provided an electrolytic cell for producing ozone. The cell includes an anode including a free-standing diamond material, and a cathode spaced from the first electrode, and a proton exchange membrane. The proton exchange membrane is between the anode and the cathode and separates the anode and the cathode.

In some embodiments, the cathode also includes a free-standing diamond material, and the cell is configured to reverse polarity between the anode and the cathode. In some embodiments, the free-standing diamond material includes boron doped diamond material.

In some embodiments, the anode and the cathode are in fluid communication to receive water from a common source, and in some embodiments the cell is configured to split source water flow into a first water flow and a second water flow, where the first water flow is supplied to the anode and the second water flow is supplied to the second electrode. In some embodiments, the cell is configured so that the first water flow and the second water flow are joined after at least one of the first water flow and the second water flow is provided with ozone. In yet other embodiments, the joined water flow is supplied to a chamber containing water, where the water within the chamber is purified by the ozone.

In some embodiments, the cell is configured to be installed within a pipe.

In yet other embodiments, the cell is free of a catholyte solution and a catholyte reservoir.

In some embodiments, the free-standing diamond material includes boron doped diamond material with a thickness of between about 100 microns and about 700 microns.

Some embodiments also include a cylindrical housing, a first semi-circular frame member, and a second semi-circular frame member. In some such embodiments, the anode, cathode and membrane are sandwiched between the first semi-circular frame member and the second semi-circular frame member, and the anode, cathode, membrane, first semi-circular frame member and second semi-circular frame member are within the cylindrical housing. In yet other embodiments, at least one of the first semi-circular frame member and the second semi-circular frame member is extendable to produce a compressive force on the anode, cathode and membrane.

In another embodiment, a diamond electrode includes a free-standing diamond material having a first side, a second side opposite to the first side, and a thickness of at least about 100 microns. The electrode also includes a current spreader coupled to the first side of the free-standing diamond material. The current spreader has an electrical contact and may have a mesh configuration or a frame configuration. In such an embodiment, the electrode is capable of conducting a current density of at least about 1 ampere per square centimeter through the free-standing diamond material for several hours (i.e., a sustained current density) without degrading the electrical conduction capacity or ozone-producing capacity of the electrode. In another embodiment, the free-standing diamond material has a thickness of at least about 200 microns.

In another embodiment, a method of operating an electrolytic cell includes providing an electrolytic cell having a first electrode of diamond material, a second electrode of diamond material, and a membrane between and separating the first electrode and the second electrode. The embodiment further includes providing, at a first time, a voltage differential across the first electrode and the second electrode, where the voltage differential has a first polarity, and then reversing, at a second time after the first time, the polarity of the voltage differential across the first electrode and the second electrode. The voltage differential has a second polarity at the second time. The method then reverses, at a third time after the second time, the polarity of the voltage differential across first electrode and the second electrode, such that the voltage differential has the first polarity at the third time.

Some embodiments include periodically reversing the polarity of the voltage differential, such that the voltage differential periodically alternates between the first polarity and the second polarity.

In some embodiments, the voltage differential produces a current flow through the first diamond material, where the current flow through the first diamond material has a current density of at least about 1 ampere per square centimeter during the entire interval between the first time and the second time.

Some embodiments also supply water to the electrolytic cell, where all of the water is supplied from a single source, and separate the water into two streams, where a first stream contacts the first electrode and the second stream contacts the second electrode. The first stream and second stream are separated by the membrane. The method then introduces ozone into the first stream at the first electrode, and then combines the first stream and the second stream to produce a combined stream, after introducing the ozone. Some embodiments direct the combined stream to a holding chamber. Other embodiments also provide additional water to the holding chamber, where the additional water is purified by the ozone.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

In accordance with one embodiment, an electrolytic cell for producing ozone in flowing water includes at least one free-standing diamond electrode. The free-standing diamond electrode is capable of handling appreciably higher power than previously-known electrodes, and among other things is capable of producing more ozone.

Figure 1A:
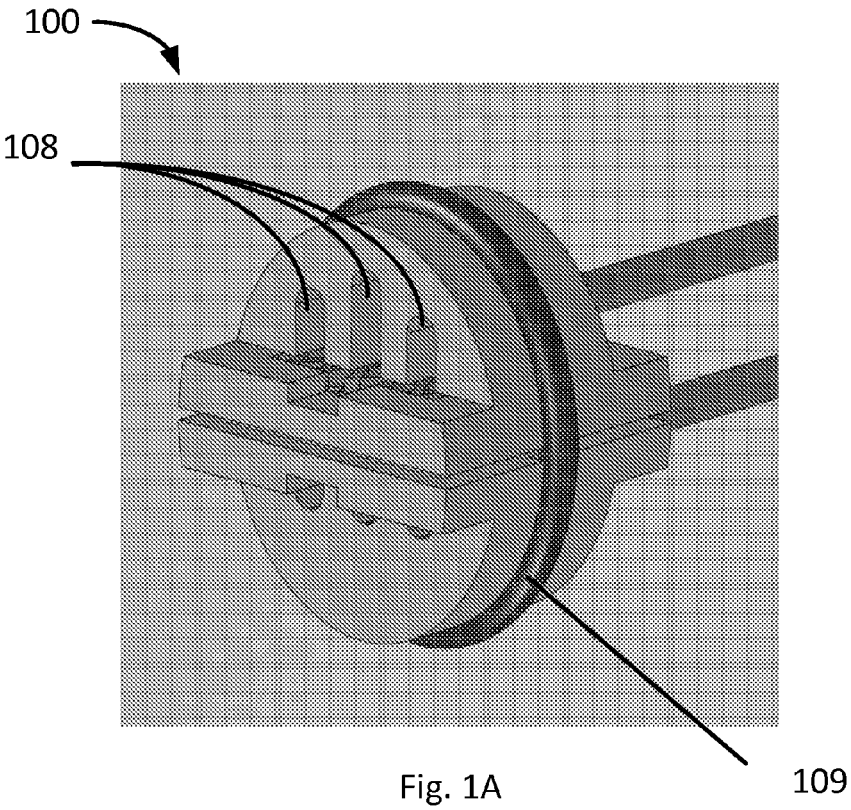
FIGS. 1A and 1B schematically illustrates an electrolytic cell according to a first embodiment.
Figure 1B:
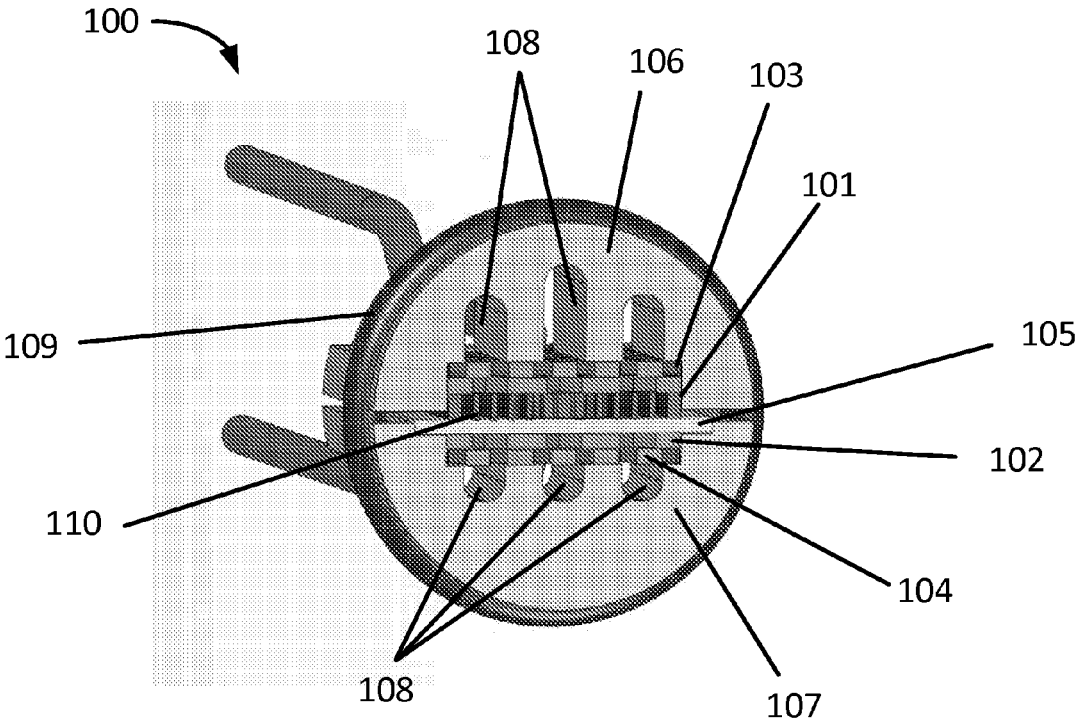

One embodiment of an electrolytic cell 100 is schematically illustrated in FIG. 1A, and a cross-section of that cell 100 is schematically illustrated in FIG. 1B, exposing the internal components of the cell 100.

As shown in FIG. 1B, the electrolytic cell 100 has two electrodes: an anode 101 and a cathode 102. In this embodiment, the anode 101 is a boron-doped free-standing diamond anode, while the cathode 102 is a formed from titanium or another conductive material. The anode 101 and the cathode 102 may include through-hole features 110 to increase their surface area and to allow water to pass through them.

To form ozone, a water source is supplied to the cell 100 and a positive electric potential is applied to the anode while a different electric potential is applied to the cathode 102, so as to create a voltage differential (or potential difference) across the anode 101 and cathode 102. In the embodiment shown in FIG. 1, the electrical potential is applied via anode and cathode contacts 103, 104. On the anode side of the cell 100, the difference in electric potential breaks up water molecules into 1) oxygen and 2) hydrogen cations. The oxygen forms into ozone, which dissolves into the water. The hydrogen cations are pulled from the anode side of the cell to the cathode side by the negative electric potential applied to cathode 102. Once on the cathode side of the cell, the cations form hydrogen bubbles.

To facilitate the movement of protons (e.g., hydrogen cations) from the anode 101 to the cathode 102, in some embodiments, a solid membrane 105 is used as a solid electrolyte and placed between the anode 101 and cathode 102 (e.g., a proton exchange membrane (PEM), such as Nafion®). Additionally, in some cases, the membrane 105 is used as a barrier to separate the source water flow on the cathode side of the cell 100 from source water on the anode side of the cell. To provide structural integrity to the membrane 105, the membrane may also include a supporting matrix (not shown).

As illustrated, the membrane 105 is between the electrodes 101 and 102 and the contacts 103 and 104. Indeed, such a configuration may describe the membrane as being "sandwiched" between the electrodes, and the arrangement of electrodes 101, 102 and membrane 105, and/or the arrangement of electrodes 101, 102, membrane 105, and contacts 103 and 104, may be described as forming an electrode sandwich. The sandwich is not limited to these components, however, and various embodiments may include other components or layers in the sandwiched stack.

In the embodiment of FIGS. 1A and 1B, the cell 100 includes an anode frame 106 and a cathode frame 107. The frames 106, 107 both position the anode 101, cathode 102, anode contact 103, cathode contact 104, and membrane 105, and provide structural integrity to the assembly. The frames 106, 107 also include one or more openings 108 through which source water can flow. The size and shape of the openings 108 can be varied to achieve different flow rates through the cathode or anode areas by varying the fluid resistance of the openings either by size, length, or some other aspect of geometry. In some illustrative embodiments, the electrolytic cell also includes an O-ring 109 about its outer periphery. When the electrolytic cell 100 is inserted into a pipe (which may be a tube or other housing), the O-ring 109 may help secure and seal the electrolytic cell 100 to the inside perimeter of the pipe. Alternately, or in addition, the O-ring 109 may also provide a compressive force against the frames 106, 107, to help "clamp" the frames 106, 107 to one another.

Figure 2:
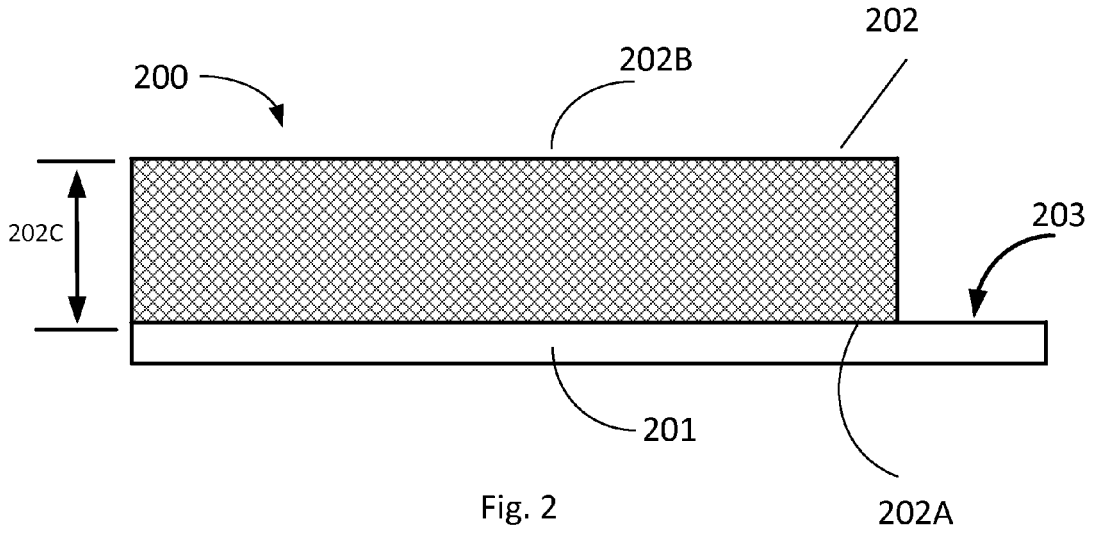
FIG. 2 schematically illustrates an electrode with a free-standing diamond.

An embodiment of a free-standing diamond electrode 200 is schematically illustrated in FIG. 2, and includes a current spreader 201 and a free-standing diamond 202.

The free-standing diamond 202 has a first side 202A, and second side 202B opposite to the first side. The diamond also has a thickness 202C, defined as the distance between the first side 202A and the second side 202B. In the embodiment in FIG. 2, the free-standing diamond has a substantially uniform thickness, which is to say that its thickness is substantially the same at all points.

As used herein and in any claim appended hereto, a "free-standing diamond" is a non-laminated doped diamond material with a thickness of greater than about 100 microns. For example, the free-standing diamond may have a thickness of 100 microns, 200 microns, 300 microns, 400 microns or more. Indeed, some embodiment may have a thickness of 500 microns, 600 microns, 700 microns or more.

These thick diamonds are beneficially capable of carrying current at high current densities for sustained periods of time without a significant deterioration in performance, and without incurring substantial damage. For example, in some embodiments, the free-standing diamond is capable of conducting sustained current density of at least about 1 ampere (or "amp") per square centimeter, while other embodiments are capable of conducting sustained current density of at least about 2 amperes per square centimeter, for example. During tests, the inventors have operated a free-standing diamond electrode at a current density of about 2 amperes per square centimeter for periods of at least about 500 continuous hours, without damaging the electrode or degrading its current carrying or ozone-producing performance. Such electrodes may produce more ozone per square centimeter of surface area than previously known electrodes, and may therefore be made more compact than a prior art electrode configured to produce the same amount of ozone per unit time. Electrodes according to various embodiments may also have longer useful and productive lifetimes than previously-known electrodes.

Figure 3:
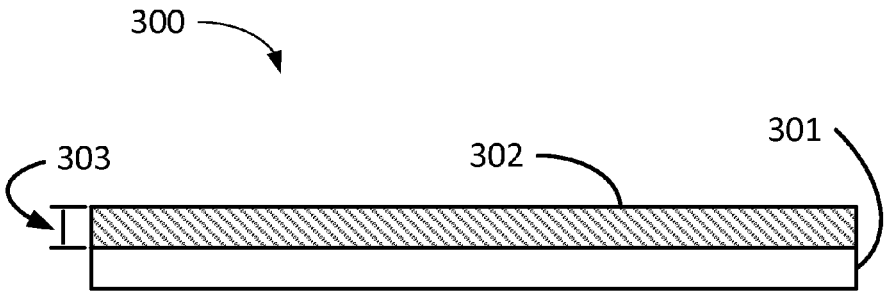
Fig. 3 (Prior Art)
FIG. 3 schematically illustrates a prior art laminated electrode.

In contrast, prior art electrodes include laminated thin-film diamond layer, such as a thin film diamond coating on a substrate. See, for example, a paper titled "*Electrochemical Ozone Production Using Diamond Anodes And A Solid Polymer Electrolyte*" by Alexander Kraft et al, Electrochemistry Communications 8 (2006), 883-886. An exemplary prior art electrode 300 is schematically illustrated in FIG. 3, and includes a substrate 301 and a thin-film diamond layer 302. The thin-film diamond layer 302 may be grown on the substrate 302; such a diamond layer does not exist before it is grown, in contrast with a free-standing diamond which may exist independent of a current spreader.

The structural and electrical integrity of the electrode 300 depends on the physical contact between the diamond layer 302 and the substrate 301. That contact, and therefore the integrity of the electrode 300, is compromised if the diamond layer 302 begins to de-laminate from the substrate 301. Such delamination may be caused, for example, by thermal stress within the electrode 300, and particularly as such thermal stress is expressed at the interface of the diamond layer 302 and the substrate 301. Thermal stress, in turn, may be caused by differences in the coefficient of thermal expansion of the diamond layer 302 and the substrate 301. Further, the thermal stress increases with increasing thickness 303 of the diamond layer.

For this reason, the diamond layers used in previously known electrodes have been of limited thickness and limited current density ratings. Limiting the thickness of the diamond layer of a laminated electrode limits the thermal stress generated as a result of the difference in the respective thermal coefficients of expansion of the diamond material and the substrate. Generally, the thickness of the diamond layer has been limited to ranges of about 10 microns or less.

However, guarding the structural integrity of an electrode by limiting the thickness of a diamond layer comes at a cost. Such electrodes have limited current density capacity. For example, current densities of less than about 400 millamps per square centimeter were reported in the paper titled "*Electrochemical Ozone Production Using Diamond Anodes And A Solid Polymer Electrolyte*" mentioned above. Indeed, some manufacturers of laminate diamond electrodes recommend keeping current density below 0.5 amps per square centimeter. Greater current densities, particularly if maintained for minutes or hours, may damage such electrodes and/or cause performance degradation, such as by causing the diamond layer and substrate to begin delaminating. Such a limited current capacity limits the electrode's ozone production capacity.

Returning to FIG. 2, the current spreader 201 is affixed to, and electrically coupled to, the free-standing diamond 202. In operation, a voltage supply may be coupled to the current spreader to connect the free-standing diamond 202 to a host system. For example, the current spreader 202 includes an extended portion 203, which extended portion may be used as an electrical contact, such as a bond to which a wire may be soldered for example. As such, the current spreader 201 is electrically conductive. In some embodiments, the current spreader may include metal, such as titanium for example.

Figure 7:
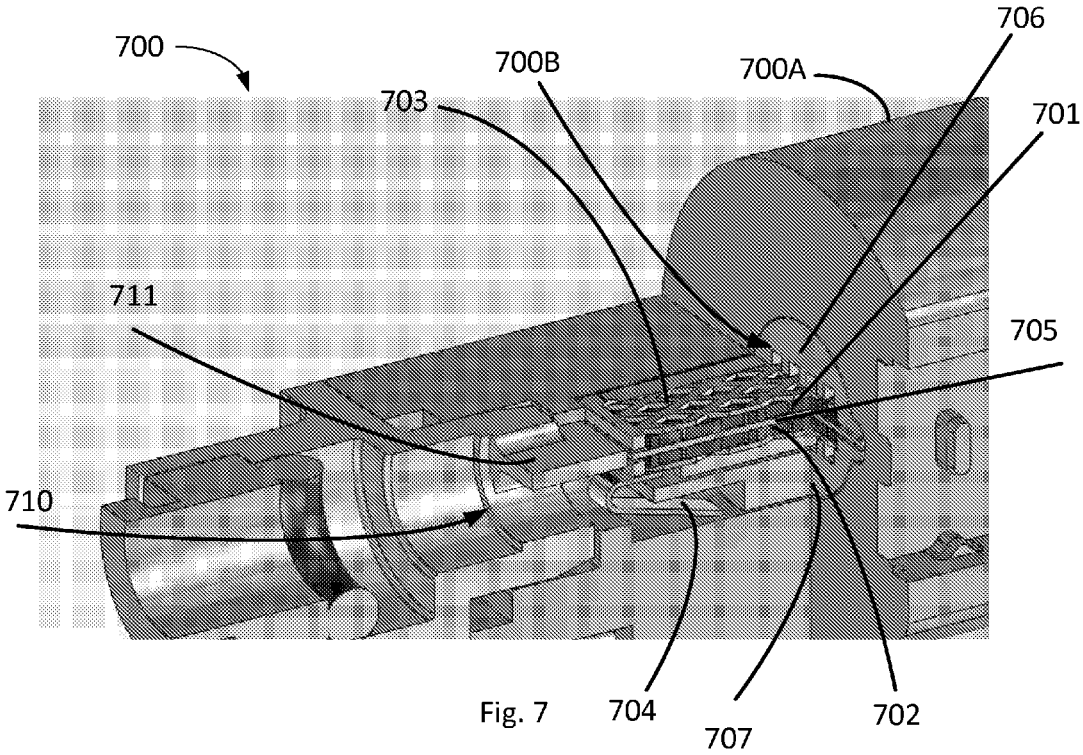
FIG. 7 schematically illustrates an embodiment of an electrolytic cell within a housing.

Various embodiments of current spreaders may take a variety of forms. For example, a current spreader may be a mesh or lattice configuration. An embodiment of a lattice current spreader 703 is schematically illustrated in FIG. 7, for example.

Figure 4A:
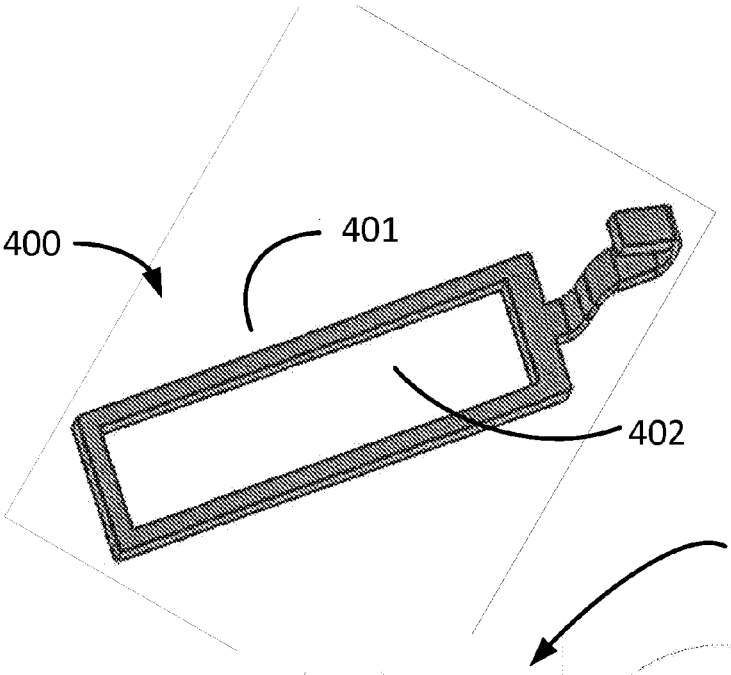
FIGS. 4A-4D schematically illustrate varies views of a current spreader.
Figure 4B:
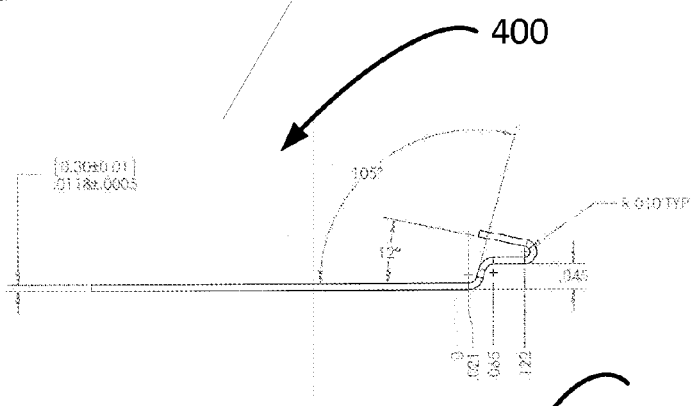
Figure 4C:
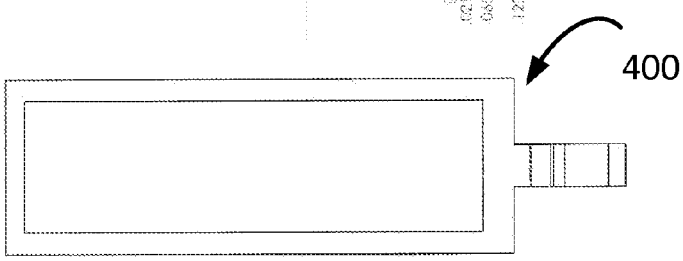
Figure 4D:
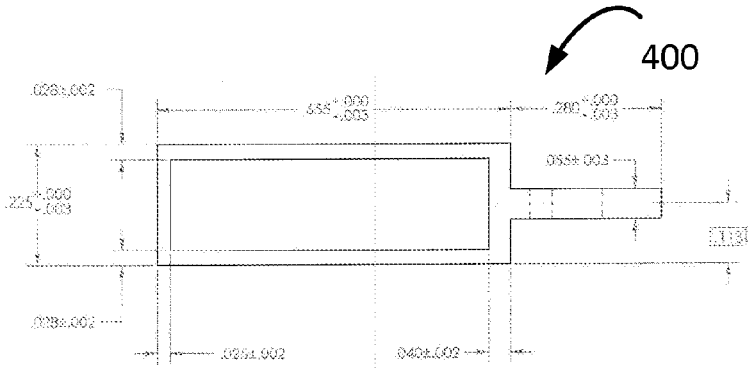

An alternate embodiment of a current spreader has a "frame" shape, so-called because a portion of the frame has a rectangular or square shape, and thereby resembles the shape of a picture frame. An embodiment of a frame configuration of a current spreader 400 is schematically illustrated in FIGS. 4A-4D, for example. Specifically, FIG. 4A presents a perspective view of the current spreader 400, while FIG. 4B presents a side view, FIG. 4C presents a top view, and FIG. 4D presents a bottom view. The currents spreader 400 is conductive, and may include titanium, for example. The dimensions in FIG. 4D are illustrative and not intended to limit various embodiments.

A frame portion 401 of the current spreader includes an aperture 402. The aperture 402, when coupled to a free-standing diamond (not shown in FIG. 4), presents a large area of the free-standing diamond to water, thereby facilitating the production of ozone. If the perimeter of the frame portion 401 defines an area, then the aperture 402 occupies most of that area. For example, the aperture 402 may occupy about 80 percent, about 90 percent, or more of the frame portion 401.

Figure 5:
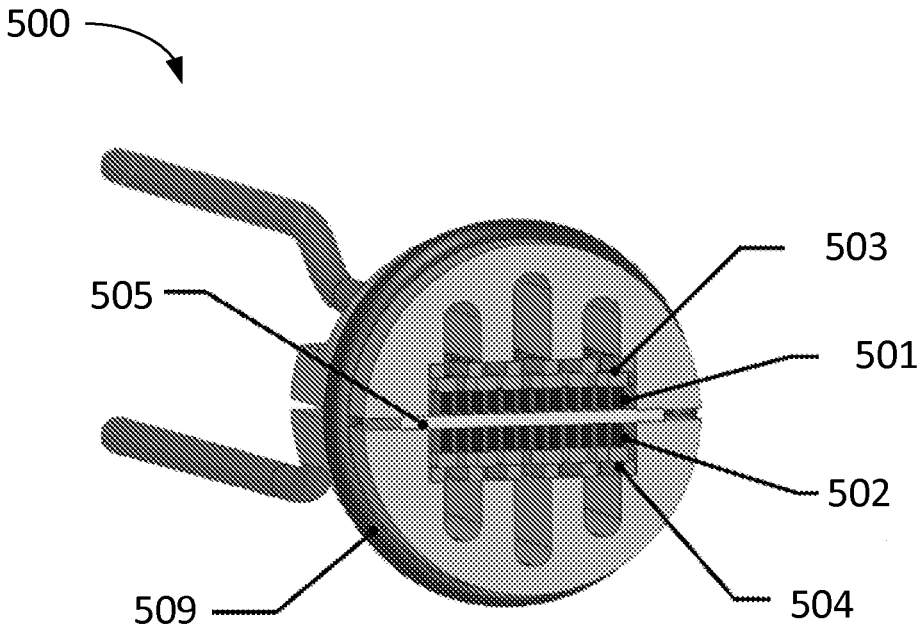
FIG. 5 schematically illustrates an electrolytic cell according to another embodiment.

An alternate embodiment of an electrolytic cell 500 is schematically illustrated in FIG. 5, and has several features similar to the electrolytic cell 100 discussed above, such as contacts 503, 504, membrane 505, and O-ring 509. Such features are not discussed again here.

The electrolytic cell 500 differs from the electrolytic cell 100, however, at least because electrolytic cell 500 has two free-standing diamond electrodes 501, 502. As such, it is not necessary to identify one electrode as the anode and another electrode as the cathode. Either of the electrodes 501, 502 are capable of acting as the anode, as the cathode, or indeed even alternating back and forth between the roles of anode and cathode. In some embodiments, the cell 500, or a system hosting the cell 500, may include circuitry to reverse the polarity of the voltages input to the electrodes. Such circuitry may include, for example, a switching network having a number of switches coupled between the input voltages and the electrodes 501 and 502 to selectively direct a first input voltage to the first electrode 501 and a second voltage to the second electrode 502, and to controllably reverse the polarity of the input voltages so as to direct the first input voltage to the second electrode 502, and the second input voltage to the first electrode 501. As such, one electrode 501 acts as the anode and the other electrode 502 acts as the cathode when the input voltage has a first polarity. However, when the input voltage polarity is reversed (i.e., to a second polarity), the first electrode 501 then acts as the cathode, and the second electrode acts as the anode.

Figure 6:
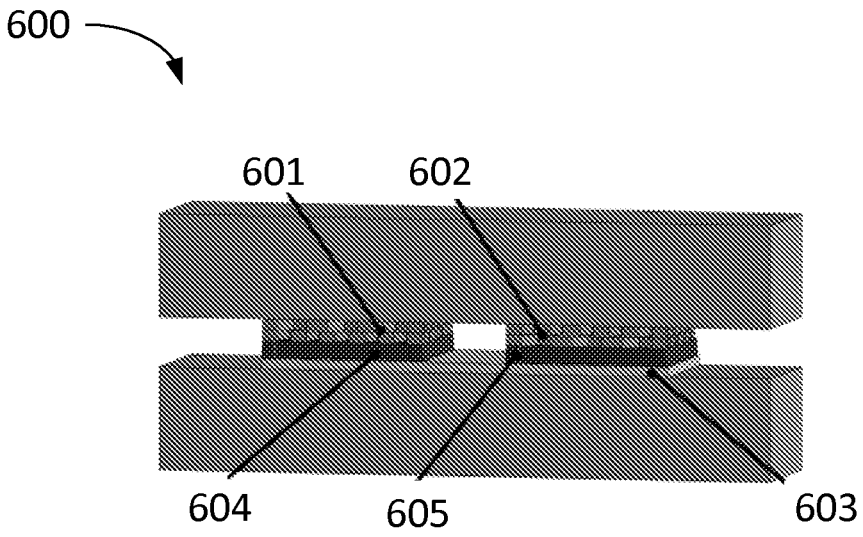
FIG. 6 schematically illustrates an electrolytic cell according to another embodiment.

FIG. 6 schematically illustrates another embodiment 600 of a two-diamond electrolytic cell. In FIG. 6, the cell 600 includes a serial configuration of boron doped diamond electrodes 601, 602 located on the same side of the membrane 603 and connected to electrode contacts 604, 605, respectively. As shown in FIG. 6, the membrane 603 is in contact with both of the diamond electrodes 601 and 602. In this configuration, cations travel horizontally through the membrane 603 between the electrodes 601 and 602.

Another embodiment of an electrolytic cell assembly 700 is schematically illustrated in FIG. 7. In this embodiment, the cell assembly 700 includes a housing 700A with a cylindrical interior volume 700B (which housing may be referred to as a cylindrical housing, irrespective of its outer shape), and the diamond electrodes 701, 702, current spreaders 703, 704, membrane 705, and semi-circular frames 706 and 707 reside within the cylindrical interior volume 700B.

In this embodiment, water is supplied to the electrodes 701, 702 via a water passage 710 which is part of the housing 700A. As the water approaches the electrodes 701, 702, it encounters a divider 711 within the water passage 710. The divider effectively forms channels that split the water into a first stream (which may be referred to as a first water flow) and a second stream (which may be referred to as a second water flow). These channels in turn direct the first stream to the first electrode 701, and the second stream to the second electrode 702. The first and second streams then flow separately, and some of the water molecules in the stream that passes the anode (which could be either electrode 701 or 702, depending on the polarity of the voltage supplied to the electrodes) will have their hydrogen atoms and oxygen atoms disassociated, and some of the oxygen atoms will then form ozone. As such, ozone is introduced into one of the streams. In some embodiments, the streams may be recombined at a point after the streams pass the electrodes 701 and 702.

In some embodiments, at least one of frames 706 and 707 may be extendable to produce a compressive force on the electrode sandwich. For example, a frame 706 and/or 707 may include two parts that are spring loaded such that the spring pushes against the two parts to urge them apart, thereby expanding the frame. As such, one part of the frame pushes against the cylindrical interior of the housing, while another part of the frame pushes against the electrode sandwich.

Figure 8:
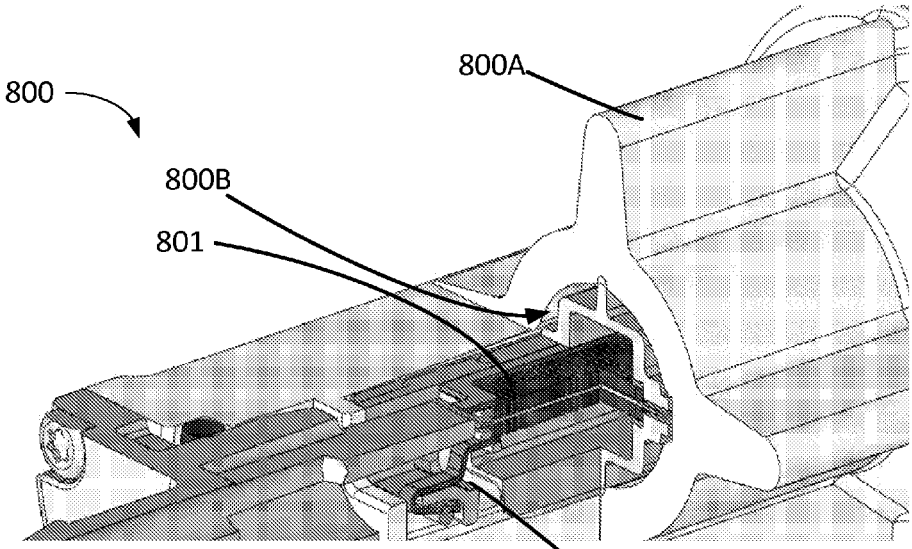
FIG. 8 schematically illustrates an alternate embodiment of an electrolytic cell within a housing.

Yet another embodiment of an electrolytic cell 800 assembly is schematically illustrated in FIG. 8. This embodiment includes a different housing 800A, but also has a cylindrical interior volume 800B. This embodiment 800 includes an electrolytic cell 801 within the cylindrical interior volume 800B. Specifically, electrolytic cell 801 includes at least one frame-shaped current spreader 802, which may be similar to current spreader 400 discussed above.

Figure 9:
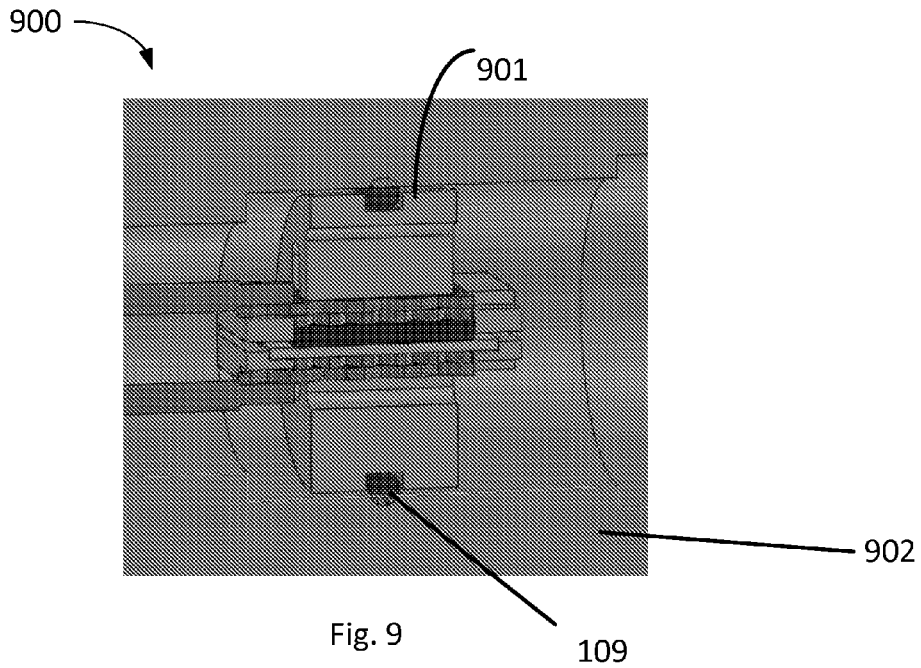
FIG. 9 schematically illustrates an embodiment of an electrolytic cell within a tube.

FIG. 9 schematically illustrates an embodiment of system 900 hosting an electrolytic cell 901. The system 900 includes an electrolytic cell 901 that is installed within the inside perimeter of a tube 902. In this embodiment, the electrolytic cell may be cell 100 as discussed above, or may be another embodiment of an electrolytic cell described herein, for example. In the embodiment of FIG. 9, the O-ring 109 prevents water from flowing between the cell 900 and the inside perimeter of the tube 901.

Figure 10:
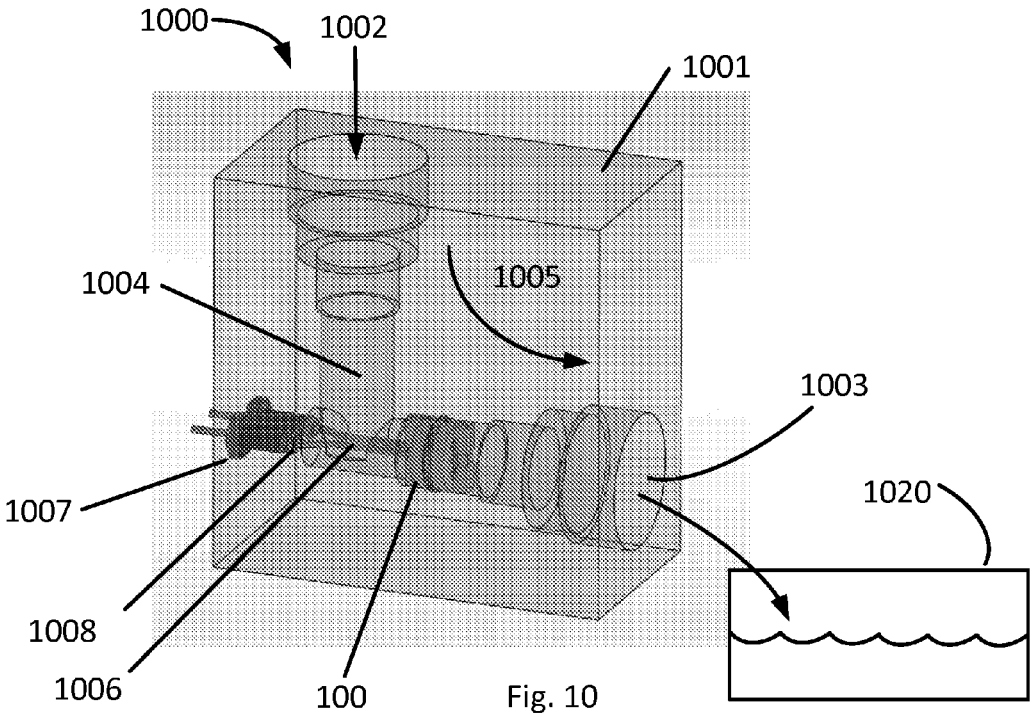
FIG. 10 schematically illustrates an embodiment of an electrolytic cell within a system.

FIG. 10 schematically illustrates another embodiment of system 1000 hosting an electrolytic cell 1000. FIG. 10 shows an electrolytic cell 100 within a housing 1001 in accordance with one embodiment of the present invention. The electrolytic cell 100 in this embodiment is the cell 100 described above, but could be selected from among other embodiments disclosed herein, such as electrolytic cell 500 to name just one example, or an entirely different cell.

The housing includes an inlet 1002, an outlet 1003, and a water passage (or "piping) 1004 connecting the inlet 1002 to the outlet 1003. In illustrative embodiments, the inlet 1002 and/or the outlet 1003 include push-n-lock tube connections for easy connection of the housing 1001 to a source water supply. Examples of connections that could be used are provided in application Ser. No. 12/769,133, which is incorporated herein, in its entirety, by reference.

According to various embodiments of the present invention, source water flows into the inlet 1002 and through the water passage 1004, the electrolytic cell 100, and the outlet 1003 in the direction shown by arrow 1005 in FIG. 10. A portion of the source water flows through the anode side of the cell 100 while another portion of the source water flows through the cathode side of the cell 100.

As the water flows through the electrolytic cell 100, a positive electric potential is applied to the anode 101 while a negative electric potential is applied to the cathode 102. The electrical potential is applied via the anode and cathode contacts 103, 104, which are, in turn, connected to a power source via electrical leads 1006. In illustrative embodiments, the anode and cathode contacts 103, 104 are formed from titanium mesh or a titanium frame current spreader that is spot welded onto the electrical leads 1006. In this way, the anode and cathode contacts 103, 104 allow source water to make contact with the surfaces of the anode 101 and the cathode 102. The electrical leads 1006 pass through walls of the water passage 1004 and, in exemplary embodiments, bushing screws 1007 and O-rings 1008 are used to prevent leakage of source water between the leads and the walls of the water passage.

As explained above, the water on the anode side of the cell 100 forms 1) oxygen and 2) hydrogen cations. The oxygen forms into ozone, which dissolves into the water, while the hydrogen cations are pulled towards the cathode side of the cell and form hydrogen bubbles. Using system 1000 as an example, the water on the cathode side of the cell 100 (including the hydrogen) and the water of the anode side of the cell (including ozone and other species) and are joined and then flow out of the output 1003.

The inventors recognized that mixing the water from the anode side the cell 100 and the cathode side of the cell has disadvantages. When the products of the electrolytic reaction are mixed, they react and recombine. For example, the hydrogen on the cathode side of the cell recombines with the ozone, hydroxyl radicals, and other oxygen derivatives from the anode side to form other species of chemicals. In some cases, as much as about 30% of the ozone may recombine downstream of the electrolytic cell 100 and, thus, reduce the net ozone production of the cell 100.

Yet, the inventors recognized that, in illustrative embodiments of the present invention, this disadvantage is outweighed by the simple and economical design of the electrolytic cell 100. As shown in the design of FIGS. 9 and 10, only a single water supply is necessary to supply the anode and cathode side of the cell 100 In contrast, in many prior art systems, the anode is supplied by a water supply and the cathode is supplied by a catholyte solution from a reservoir. This prior art arrangement adds complexity and cost to the electrolytic cell.

Furthermore, the inventors realized that the disadvantages associated with mixing products such as hydrogen and ozone can be limited by minimizing the exposure time of the products to one another. More particularly, the inventors discovered that exposure time can be minimized by flowing the water and the products into a large chamber or reservoir 1020. In the chamber, the buoyant hydrogen bubbles rise to the top and move away from the ozone and, thus, no longer react and recombine. In one exemplary embodiment of the invention, the products flow into a large chamber immediately after they are formed. Typically, the less time the products (ozone and hydrogen) spend within the turbulent flow of the water passages, the less they recombine to nullify the ozone production of the cell.

The inventors have also recognized that there are certain disadvantages associated with an electrolytic cell that does not have catholyte solution supplied from a reservoir. During the electrolytic reaction, scale (e.g., calcium carbonate) from source water builds up or deposits on the membrane 105 and other components of the cell 100. Eventually, if it does build up as noted, the scale impedes the electrochemical reaction within the cell 100. Such deposits within the electrolytic cell 100 can shorten useful cell life, or require disassembly and cleaning of internal components to restore cell performance and efficient production of target chemistries, such as ozone. To help prevent this problem, prior art systems use a reservoir of catholyte solution (e.g., water with sodium chloride and/or citric acid) and apply the solution to the surface of the membrane and the cathode of the prior art devices. The catholyte solution helps prevent the buildup of scale on the membrane and the cathode and, thus, improves cell efficiency.

Nonetheless, the inventors have recognized that, although the catholyte solution helps prevent the buildup of scale, it also requires the use of additional parts and further complicates and adds cost to the design of electrolytic cells and systems that use them. The inventors further recognized that, in illustrative embodiments of the present invention, the disadvantages associated with scale build up are outweighed by the simple and economical design of the electrolytic cell 100. As shown in the design of FIGS. 9 and 10, for example, illustrative embodiments of the present invention do not include a reservoir or a catholyte solution—in other words, such embodiments are free of a reservoir and a catholyte solution. This economical and simple design of the cell 100 allows for it to be replaced once it is no longer efficient.

Illustrative embodiments of the present invention are particularly useful as disposable and low cost solutions for water purification. Whereas more expensive and complex prior art systems require replacement of catholyte solution and/or disassembly of the cell to restore efficiency, illustrative embodiments of the electrolytic cell are simply removed, disposed of, and replaced with a new cell assembly. Although illustrative embodiments of the cell may have limited life times (albeit longer lifetimes that previously known cells), it may be more cost effective to simply replace disposable cells instead of maintaining more complex prior art electrolytic cells. Such disposable electrolytic cells are particularly useful when the source water supply has low levels of impurities. In such circumstances, scale build up is low and further mitigates the need for a catholyte solution. Other factors may also be present that mitigate the need for a catholyte solution.

Figure 11:
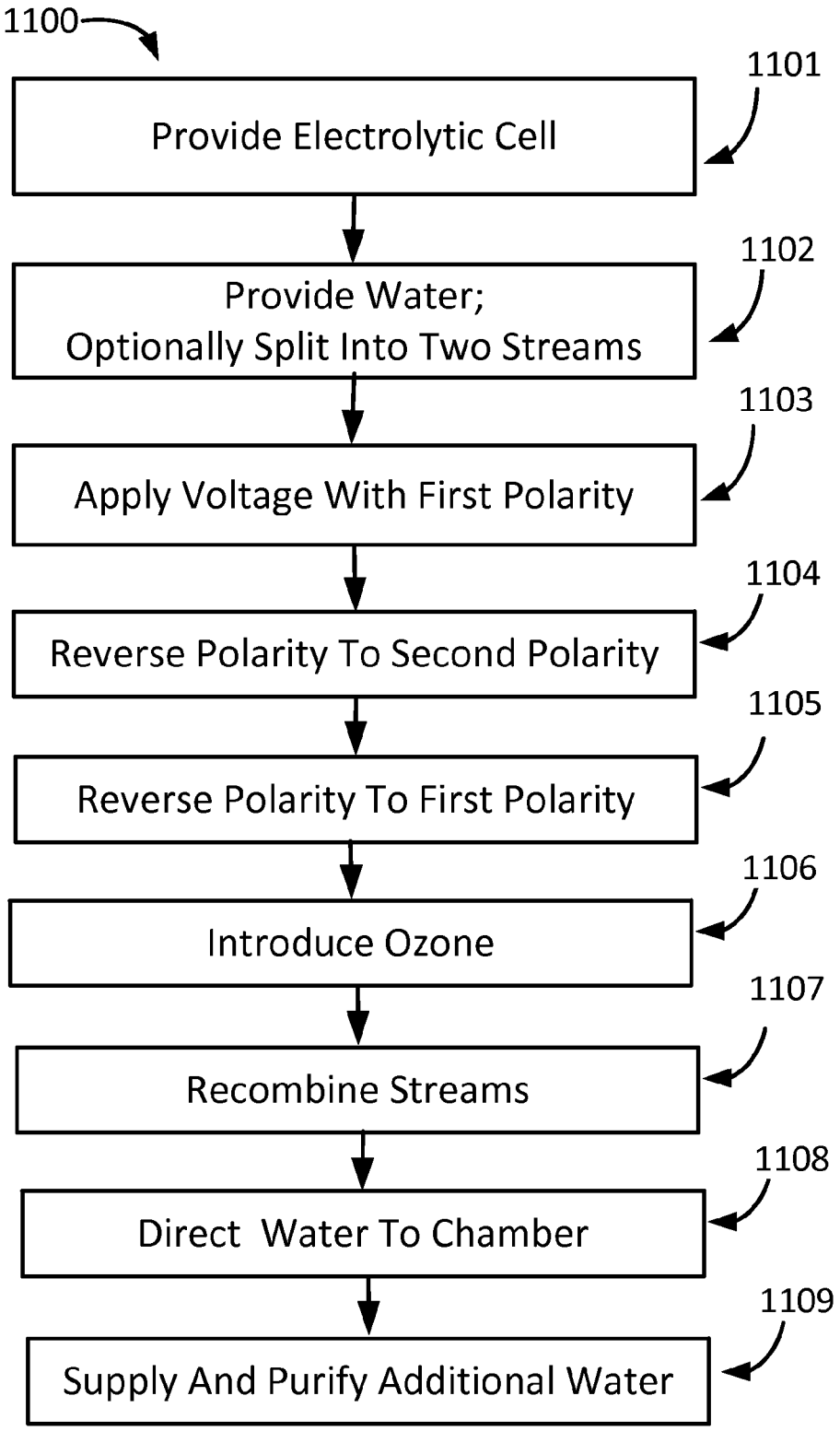
FIG. 11 illustrates a method of operating an electrolytic cell.

A method 1100 of operating an electrolytic cell is illustrated in FIG. 11. As mentioned above, in an electrolytic cell that has two free-standing diamond electrodes, it is not necessary to identify one electrode as the anode and another electrode as the cathode. Either of the electrodes is capable of acting as the anode, as the cathode, or indeed even alternating back and forth between the roles of anode and cathode. This characteristic allows the operation of an electrolytic cell in such a way as to mitigate the buildup of scale.

As such, the method begins with by providing an electrolytic cell including a first electrode having a diamond material and a second electrode having a diamond material (step 1101). The electrolytic cell may be similar to the cells described above, or may be of another design. In some embodiments, the diamond electrodes are free-standing diamonds, but in other embodiments the diamond electrodes may even include laminated diamond layers as known in the art. The electrolytic cell also includes a membrane between the first electrode and the second electrode and separating the first electrode and the second electrode.

In operation, water is supplied to the electrolytic cell (step 1102). As mentioned above, some embodiments separate the incoming water into first and second streams, and direct the first stream to an anode, and the second stream to the cathode. As such, some embodiments separate the water into such streams at step 1102. As noted above, some embodiments to not require or use an electrolyte solution. As such, all of the water may be supplied from a common source, rather than have some water supplied from a water source, and an electrolyte solution supplied from a different source. Therefore, some embodiments, supply water to the electrolytic cell from a single or common source.

As mentioned above, an electrical potential difference is supplied across the electrodes when the cell is in operation. As such the method also provides, in step 1103 at a first time, a voltage differential across the first electrode and the second electrode, the voltage differential having a first polarity.

While in this configuration, scale may begin or continue to build up on the electrodes. To combat scale build up, the next step reverses the polarity of the voltages to the first electrode and the second electrode (step 1104). This step 1104 is performed at a second time later than the first time, and the voltage differential thereby has a second (opposite, or inverse) polarity at the second time. By reversing the polarity of the voltage, the forces of attraction between the electrodes and the scale is also reversed, such that an electrode that attracted scale under the first polarity, now repels scale under the second polarity. Repeated reversal of the polarity over time (e.g., first polarity; second polarity; first polarity; second polarity, etc.) may help mitigate scale buildup, and may even reverse previously built-up scale.

As such, the process includes another reversal of the voltage differential at a third time after the second time (step 1105). This new voltage differential has the first polarity at the third time.

This process or cycle of polarity reversal may be repeated periodically. The period of the cycle may be determined by the systems operator, and the chosen period may depend on such factors as the size of the electrolytic cell, the rate of water flow past the electrodes, and the content (e.g., impurity content) of the water, among other things. For example, the polarity may be reversed once each minute, once each hour, once each day, or periodically, periodically or even randomly at various intervals.

The applied voltage differential produces a current flow through the first diamond material. In illustrative embodiments, this current flow through the first diamond material has a current density of at least about 1 ampere per square centimeter during the entire of interval between the first time and the second time. For example, during this time, the current flow can have a current density of about 1.5 amperes per square centimeter, about 2 amperes per square centimeter, 3 amperes per square centimeters, or great amounts as determined by those skilled in the art.

Then, the method introduces ozone into the first stream at the first electrode at step 1106. Finally, the method combines the first stream and the second stream to produce a combined stream at step 1107, after introducing the ozone.

Some embodiments also direct the combined stream to a holding chamber (step 1108). Further, some embodiments provide additional water to the holding chamber, where the additional water is purified by the ozone (step 1109). The additional water may be provided before, after, or during the arrival of the combined stream of ozone-laden water to the holding chamber.

The embodiments of the invention described above are intended to be merely exemplary; numerous variations and modifications will be apparent to those skilled in the art. For example, but without limitation, some embodiments describe a system with a specified electrolytic cell, but generally any such system could be configured to use any of the cells described above. As another example, the method of FIG. 11 includes both splitting the water stream, and reversing polarity of the voltage across the electrodes. However, a method that splits the water stream could be implemented without reversing the polarity of the voltage, and a method that reverses the polarity of the voltage could be implemented without splitting the water stream. All such variations and modifications are intended to be within the scope of the present invention as defined in any appended claims.

What is claimed is:

1. An electrolytic cell for producing ozone, the cell comprising:

a first electrode including a free-standing diamond material;

a second electrode spaced from the first electrode; and a proton exchange membrane separating the first electrode and the second electrode, the proton exchange membrane being between the first electrode and the second electrode, the cell further comprising:

a cylindrical housing;

a first semi-circular frame member; and a second semi-circular frame member, wherein the first electrode, the second electrode, and the proton exchange membrane are sandwiched between the first semi-circular frame member and the second semi-circular frame member; and the first electrode, the second electrode, the proton exchange membrane, the first semi-circular frame member and the second semi-circular frame member are within the cylindrical housing.

2. The cell according to claim 1, wherein the second electrode includes a free-standing diamond material, and the cell is configured to reverse polarity between the first electrode and the second electrode.

3. The cell according to claim 1, wherein the free-standing diamond material includes boron doped diamond material.

4. The cell according to claim 1, wherein the first electrode and the second electrode are configured to receive water from a common source.

5. The cell according to claim 4, wherein the cell is configured to split source water flow into a first water flow and a second water flow, the cell further comprising a first channel to supply the first water flow to the first electrode, the cell also comprising a second channel to supply the second water flow to the second electrode.

6. The cell according to claim 5, wherein the cell is configured so that the first water flow and the second water flow are joined after at least one of the first water flow and the second water flow is provided with ozone.

7. The cell according to claim 6, wherein the joined water flow is supplied to a chamber containing water, whereby the water within the chamber is purified by the ozone.

8. The cell according to claim 1, wherein the cell is configured to be installed within a pipe.

9. The cell according to claim 1, wherein the cell is free of a catholyte solution and a catholyte reservoir.

10. The cell according to claim 3, wherein the free-standing diamond material includes boron doped diamond material with a thickness of between about 100 microns and about 700 microns.

11. The cell according to claim 1, wherein at least one of the first semi-circular frame member and the second semi-circular frame member is configured to produce a compressive force on the first electrode, the second electrode, and the proton exchange membrane.

12. The cell according to claim 1, wherein the free-standing diamond material has a first side, a second side opposite the first side, and a thickness of at least about 100 microns; the first electrode further comprising:

a current spreader coupled to the first side of the free-standing diamond material, the current spreader having an electrical contact and one of a mesh configuration and a frame configuration, wherein the electrode is configured to conduct a sustained current density of at least about 1 ampere per square centimeter through the free-standing diamond material for several hours without degrading the electrical conduction capacity or ozone-producing capacity of the electrode.

13. The diamond electrode according to claim 12, wherein the current spreader has a frame configuration.

14. The diamond electrode according to claim 12, wherein the free-standing diamond material has a thickness of at least about 200 microns.

* * * * *